US009969163B2

(12) United States Patent
Muraoka et al.

(10) Patent No.: US 9,969,163 B2
(45) Date of Patent: May 15, 2018

(54) LIQUID DISCHARGE HEAD

(71) Applicant: CANON KABUSHIKI KAISHA, Tokyo (JP)

(72) Inventors: Chiaki Muraoka, Kawaguchi (JP); Keiji Tomizawa, Yokohama (JP); Takuma Kodoi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/347,652

(22) Filed: Nov. 9, 2016

(65) Prior Publication Data

US 2017/0136769 A1 May 18, 2017

(30) Foreign Application Priority Data

Nov. 12, 2015 (JP) ..... 2015-221840

(51) Int. Cl.
*B41J 2/14* (2006.01)

(52) U.S. Cl.
CPC .... *B41J 2/1433* (2013.01); *B41J 2002/14491* (2013.01)

(58) Field of Classification Search
CPC ..... B41J 2/1433; B41J 2/14233; B41J 2002/14491
See application file for complete search history.

(56) References Cited

U.S. PATENT DOCUMENTS

2011/0292122 A1* 12/2011 Anderson ..... B41J 2/155 347/43
2013/0083120 A1* 4/2013 Choy ..... B41J 2/16505 347/29
2013/0257995 A1* 10/2013 Sakurai ..... B41J 2/0455 347/56

FOREIGN PATENT DOCUMENTS

JP 63-135174 U 9/1988

* cited by examiner

*Primary Examiner* — Jason Uhlenhake
(74) *Attorney, Agent, or Firm* — Canon U.S.A., Inc. IP Division

(57) ABSTRACT

A liquid discharge head includes a discharge unit that discharges a liquid as a result of electric energy being supplied to the discharge unit, a first wiring member that is joined to the discharge unit and that includes a plurality of first joining terminals each capable of transmitting the electric energy to the discharge unit, and a second wiring member that is electrically joined to the first wiring member and that includes a plurality of second joining terminals. At least three of the plurality of first joining terminals are inspection terminals that are short-circuited, and the second joining terminals are connected to contact terminals to each of which an external signal can be input.

6 Claims, 6 Drawing Sheets

LIQUID DISCHARGE HEAD

BACKGROUND OF THE INVENTION

Field of the Invention

The invention relates to liquid discharge heads that are driven by electric signals, and more particularly to a liquid discharge head to which an electric signal is transmitted via a plurality of electrical components joined to the liquid discharge head.

Description of the Related Art

In a common liquid discharge head of the related art, an electric signal is supplied to a discharge element from the outside via a plurality of electrical components (a wiring substrate and a wiring tape). Here, the plurality of electrical components need to be joined together with a resistance that is equal to or lower than a predetermined value in order to suppress degradation of signal integrity and loss of electric energy. However, the size of the joining region where the electrical components are joined together increases as the size of the electrical components increases, and it is difficult to join the electrical components together in such a manner that the resistance is equal to or lower than a predetermined value over the entire joining region.

When a failure occurs in a joint portion between the electrical components, in the case where an electric signal cannot be transmitted to the discharge element due to deterioration of the signal integrity, the failure can be detected as an initial discharge failure during inspection prior to shipping. However, in the case of a joint failure such as one that causes only loss of electric energy, when the loss is small, there is a possibility that the failure will not be detected as a discharge failure during the inspection prior to shipping, and that the failure will become notable along with aging of a product (e.g., in the case where the discharge element is a heater, a burn mark on a surface of the heater and the like) during the use of the product. In order to avoid bringing to market a liquid discharge head in which such a discharge failure will possibly occur, there is a need to ensure the quality of shipped goods by inspecting and managing the state of the joints between a plurality of electrical components by using resistance values in the manufacturing process.

Japanese Unexamined Utility Model Registration Application Publication No. 63-135174 discloses a flexible joining conductor such as a flexible printed circuit board or a flat cable that has a diagnostic function for determining breakage. A dummy conductor is disposed at a side end of the flexible joining conductor, and the flexible joining conductor includes a breakage detection unit that detects breakage of the dummy conductor. Accordingly, the flexible joining conductor is capable of detecting beforehand that a failure, which has occurred therein, has progressed and is capable of taking appropriate measures against the failure before a signal line breaks.

However, in the diagnostic function for determining breakage described in Japanese Unexamined Utility Model Registration Application Publication No. 63-135174, Boolean determination having two results, which are a conducting state and a non-conducting state, is performed, and thus, a state cannot be detected where the resistance is equal to or higher than a predetermined value, despite conduction, and as a result, inspection of a joint portion cannot be performed with high accuracy.

SUMMARY OF THE INVENTION

A liquid discharge head according to an embodiment of the present invention includes a discharge unit that discharges a liquid as a result of electric energy being supplied to the discharge unit, a first wiring member that is joined to the discharge unit and that includes a plurality of first joining terminals each capable of transmitting the electric energy to the discharge unit, and a second wiring member that is electrically joined to the first wiring member and that includes a plurality of second joining terminals. At least three of the plurality of first joining terminals are inspection terminals that are short-circuited, and the second joining terminals are connected to contact terminals to each of which an external signal can be input.

Further features of the present invention will become apparent from the following description of exemplary embodiments with reference to the attached drawings.

DESCRIPTION OF THE EMBODIMENTS

An embodiment of the present invention will be described below with reference to the drawings.

Figure 1:
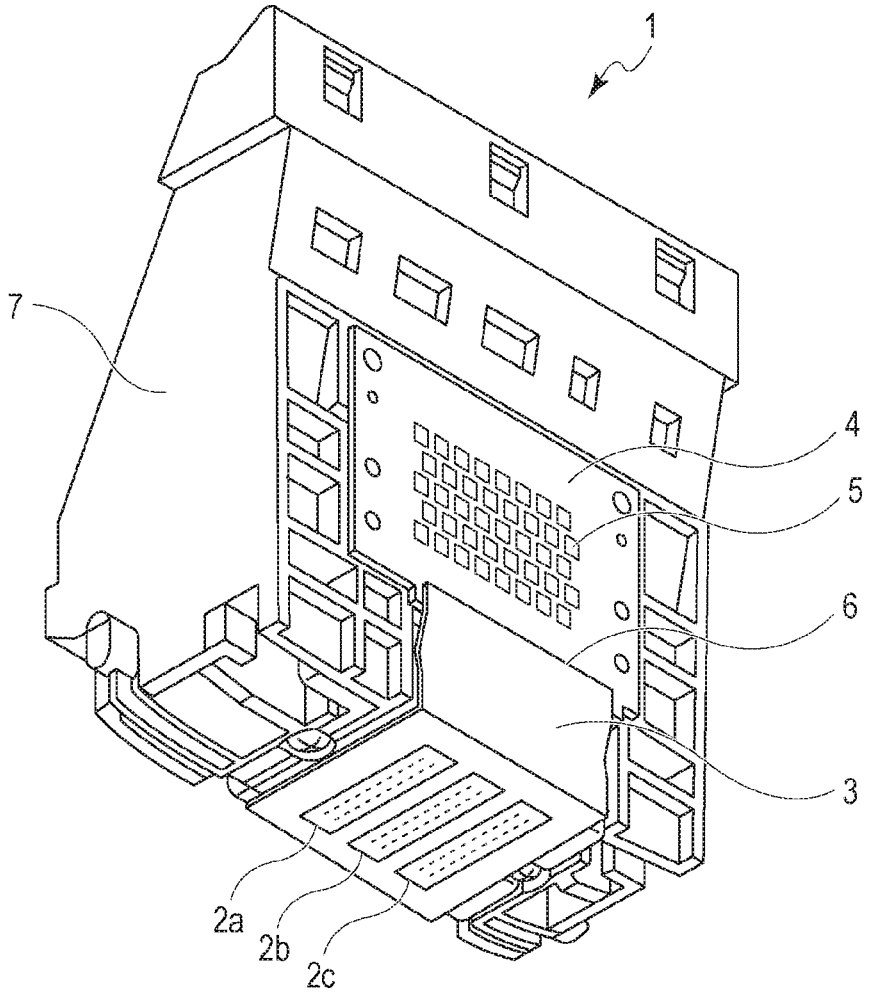
FIG. 1 is a perspective view of a liquid discharge head.

FIG. 1 is a perspective view of a liquid discharge head (hereinafter also simply referred to as discharge head) 1 to which the present embodiment can be applied. The discharge head 1 includes three discharge-element substrates 2*a*, 2*b*, and 2*c*, and each of the discharge-element substrates 2*a*, 2*b*, and 2*c* includes a plurality of discharge elements, each of which discharges a liquid (hereinafter also referred to as ink). A flexible cable 3, which is a first wiring member, is a flexible wiring member that is provided with wiring lines used for supplying (that are capable of transmitting) power and drive signals to all the discharge-element substrates 2*a*, 2*b*, and 2*c*. A contact substrate 4, which is a second wiring member, is a printed circuit board provided with internal wiring lines, which are electrically connected to the wiring lines of the flexible cable 3, and includes contact terminals 5 to each of which power and a drive signal are input from the outside of the liquid discharge head 1. Here, the flexible cable 3 and the contact substrate 4 are joined together by a joint portion 6. A housing 7 is a mother that holds and fixes each of the above-mentioned electrical components in place and includes an ink flow path that communicates with the discharge elements on the discharge-element substrates 2*a*, 2*b*, and 2*c* so as to transport to the discharge elements an ink that is supplied from an ink tank positioned outside the liquid discharge head 1.

Figure 2:
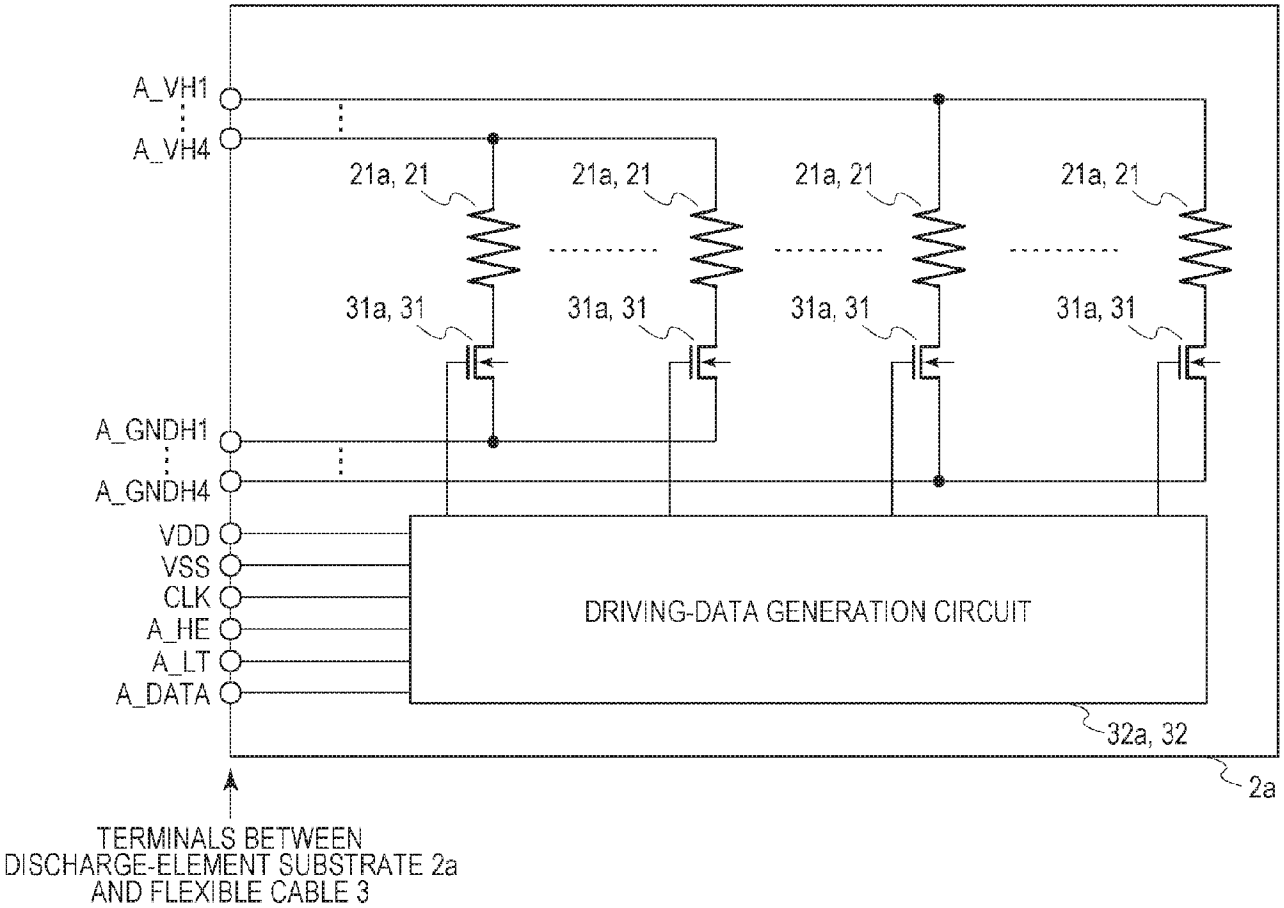
FIG. 2 is a diagram illustrating an electric signal, which is input to a discharge-element substrate, and a driving circuit of a discharge element.

FIG. 2 is a diagram illustrating an electric signal, which is input to the discharge element substrate 2*a*, and a driving circuit of the discharge elements 21*a*. Overviews of the type of the electric signal, which is input to the discharge element substrate 2*a*, and the driving circuit configuration of the discharge elements 21*a* will be described below with reference to FIG. 2. Note that the same type of electric signals are input to the other two discharge-element substrates 2*b* and 2*c*, and each of the discharge-element substrates 2*b* and 2*c* has a driving circuit configuration similar to that described below.

Each of the discharge elements 21*a* is a heater that generates heat by being supplied with electric energy and generates a discharge pressure in the ink which is supplied. The reference A_VH denotes a power supply of the discharge elements 21*a*, and the reference A_GNDH denotes a ground of the power supply. The power supply of the discharge elements 21*a* is divided into four independent line groups, that is, four lines of A_VH1 and A_GNDH1, A_VH2 and A_GNDH2, A_VH3 and A_GNDH3, and A_VH4 and A_GNDH4. The discharge element substrate 2*a* includes a driving-data generation circuit 32, drivers 31, and discharge elements 21. The discharge elements 21*a* are on-off-controlled by drivers 31*a*, and an on-off control signal used in the on-off control is generated from electric signals VDD, VSS, CLK, A_HE, A_LT, and A_DATA that are input to a driving-data generation circuit 32*a*. Here, the reference VDD denotes a power supply of driving data, and the reference VSS denotes a ground of the power supply. The reference CLK denotes a clock for transfer of the driving data, and the reference A_HE denotes a signal that defines the length of each driving pulse of the discharge elements 21*a*. The reference A_LT denotes a trigger signal that is used when transferring the driving data, and the reference A_DATA denotes a data signal that instructs switching on and off of each of the plurality of discharge elements 21*a*.

Transmission and reception of the electric signals are performed via the wiring lines of the flexible cable 3 and a joining terminal that joins the discharge-element substrate 2*a* and the flexible cable 3. Note that the wiring lines of the flexible cable 3 are joined to the terminals of the contact substrate 4.

Figure 3:
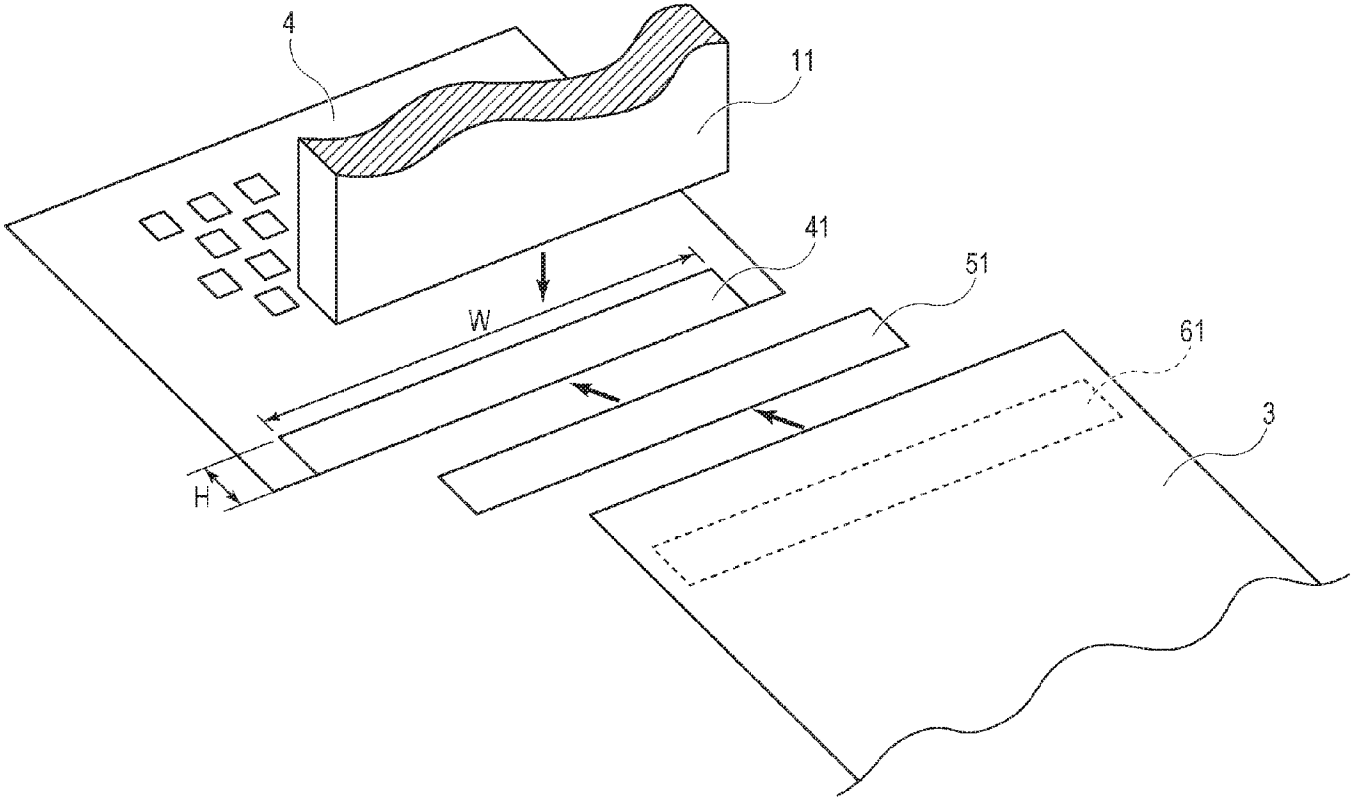
FIG. 3 is a diagram illustrating a method of joining a flexible cable and a contact substrate together.

FIG. 3 is a diagram schematically illustrating a method of joining the flexible cable 3 and the contact substrate 4 together. The contact substrate 4 and the flexible cable 3 are joined together by thermocompression bonding that interposes an anisotropic electroconductive tape (hereinafter also referred to as ACF tape) 51 between the contact substrate 4 and the flexible cable 3. In other words, the ACF tape 51 is temporarily attached to a group of joining terminals 41 (second joining terminals) of the contact substrate 4, and a group of joining terminals 61 (a plurality of first joining terminals) of the flexible cable 3 are arranged on the ACF tape 51 while bringing the joining terminals 41 and the joining terminals 61 into alignment with each other. Then, a predetermined load and heat are applied for a certain time by a press-bonding horn 11, which has been heated, to the entirety of a joining region where the contact substrate 4 and the flexible cable 3 are joined together so as to press and fix the contact substrate 4 and the flexible cable 3 to each other.

In this case, when the load and the heat are not uniformly applied to the entire joining region, there will be an area in the joining region in which the amount of compression of the ACF tape 51 is small. In an area in which the amount of compression of the ACF tape 51 is small, a joining resistance may sometimes be equal to or higher than an assumed value. A high joining resistance causes an increase in the wiring resistance of an electrical wiring path, which in turn results in insufficient supply of electric energy that is to be applied to the discharge elements, and a discharge failure in which the ink will not be discharged may sometimes occur.

Portions in which the joining resistance is high due to an insufficient amount of compression of the ACF tape 51 are concentrated at the two ends or at the center of the joining region in the width direction (direction indicated by W in FIG. 3) of the joining region. For example, in the case where the press-bonding horn 11 is deformed when being heated and where there is a large influence of the deformation of a press-bonding surface of the press-bonding horn 11 in a convex manner so as to have an arch shape with the center thereof corresponding to the center of the press-bonding surface, the load to be applied during the press-bonding operation becomes insufficient in the two end portions of the joining region rather than in the center portion of the joining region, and as a result, a press-bonding failure occurs intensively at the two end portions. In addition, for example, in the case where the press-bonding operation is performed by using the press-bonding horn 11 whose center portion has been processed in a recessed manner by taking the thermal deformation of the press-bonding horn 11 into consideration, when the amount of deformation during the press-bonding operation is smaller than the amount by which the center portion has been processed, the load becomes insufficient at the center portion, and as a result, a press-bonding failure occurs intensively at the center portion. Furthermore, for example, when the press-bonding operation is performed while the entire press-bonding surface of the press-bonding horn 11 is inclined in the width direction (direction indicated by W in FIG. 3), the load becomes insufficient at one of the two end portions, and as a result, a press-bonding failure occurs intensively at one of the two end portions. In particular, a press-bonding failure is more likely to occur as the width W of the joining region increases. In addition, the likelihood of a press-bonding failure occurring increases also in the case where the height H of the joining region increases.

Since the press-bonding surface of the press-bonding horn 11 is formed with the aim of performing a press-bonding operation on a flat surface, it is less likely that a press-bonding failure will occur locally (e.g., in only one electrical wiring line), and when a failure occurs in one electrical wiring line, a failure also often occurs in a plurality of adjacent wiring lines. Conversely, when it is confirmed that no failure has occurred in a certain wiring line, it can be determined that no failure has occurred in a plurality of adjacent wiring lines either.

Figure 4:
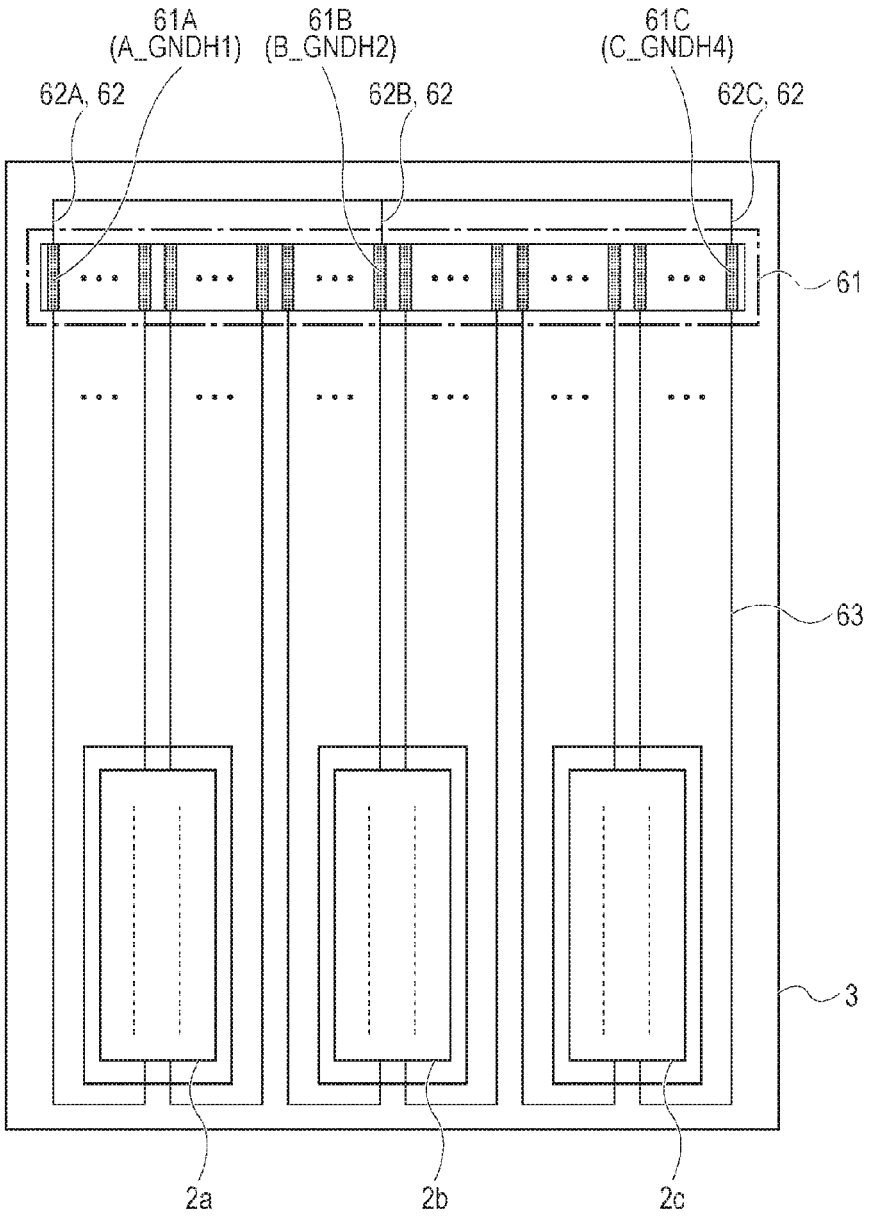
FIG. 4 is a diagram illustrating a configuration of the flexible cable.

FIG. 4 is a diagram illustrating the configuration of the flexible cable 3. A plurality of wiring lines 63 that transmit electric signals to the discharge-element substrates 2*a*, 2*b*, and 2*c* are wired in the single flexible cable 3. The wiring lines 63 joined to the discharge-element substrates 2*a*, 2*b*, and 2*c* are joined to the joining terminals 61 of the contact substrate 4 that are exposed to the outside of a rear surface (a surface being located on the side opposite to the side on which ink discharge surfaces of the discharge-element substrates 2*a* to 2*c* are present) of the flexible cable 3.

In the present embodiment, three terminals among the joining terminals 61 are short-circuited by inspecting wiring lines 62 that are disposed on the side opposite to the side on which the wiring lines 63 are disposed. Here, joining terminals 61A, 61B, and 61C, to which the inspection wiring lines 62 are joined, are ground terminals of the discharge elements, and the joining terminals 61A, 61B, and 61C are respectively joined to a ground A_GNDH1 of the discharge element substrate 2*a*, a ground B_GNDH2 of the discharge element substrate 2*b*, and a ground C_GNDH4 of the discharge element substrate 2*c*. The joining terminals 61A and 61C are positioned at the ends of an array of the joining terminals 61, and the joining terminal 61B is positioned substantially at the center of the array of the joining terminals 61.

Figure 5:
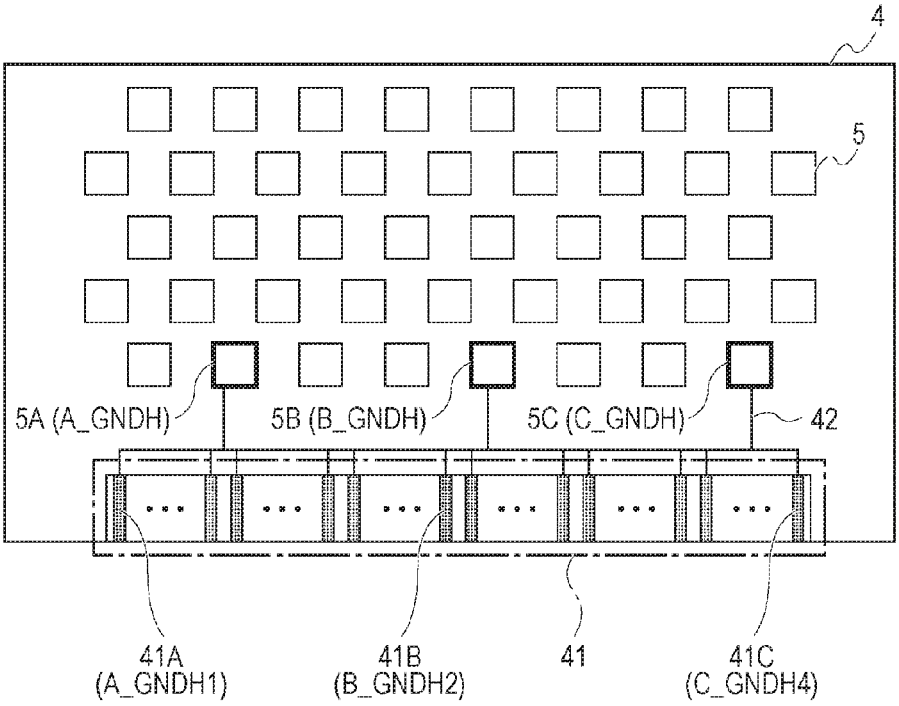
FIG. 5 is a diagram illustrating a configuration of the contact substrate.

FIG. 5 is a diagram illustrating the configuration of the contact substrate 4. Here, wiring lines 42 in the contact substrate 4 that are associated with only the ground terminals (GNDH) of the discharge elements, the ground terminals being connected to the inspection wiring lines 62 in the flexible cable 3, will be described. Each of the discharge-element substrates 2*a*, 2*b*, and 2*c* includes four ground terminals (GNDH) of the discharge elements. The four terminals of each of the discharge-element substrates 2*a*, 2*b*, and 2*c* are connected to one another by a common wiring in the contact substrate 4 and are exposed to the outside as one of common contact pads 5A, 5B, and 5C.

Figure 6:
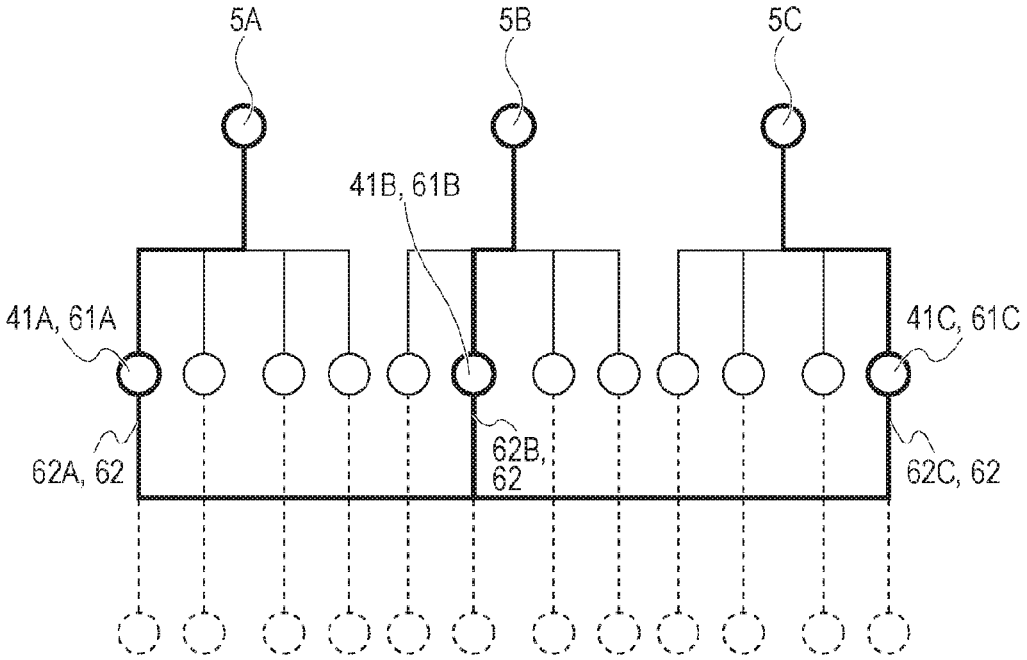
FIG. 6 is a diagram illustrating an inspection circuit.

FIG. 6 is a diagram illustrating an inspection circuit according to the present embodiment. In the present embodiment, three terminals of the contact pads 5A, 5B, and 5C serve as inspection terminals, and measurement of the resistance between each two terminals among the three inspection terminals is performed so as to inspect the state of the joint between the contact substrate 4 and the flexible cable 3.

In order to inspect the state of the joint between a joining terminal 41A and the joining terminal 61A, first, measurement of the resistance between the terminals of the contact pads 5A and 5B is performed. When the resistance is equal to or lower than a predetermined standard value, it can be determined that the joining terminal 41A and the joining terminal 61A are properly joined together and that a joining terminal 41B and the joining terminal 61B are properly joined together. When a resistance that exceeds the predetermined standard value has been measured as a result of the resistance measurement (5A-5B), measurement of the resistance between the terminals of the contact pads 5A and 5C is performed. When the resistance is equal to or lower than the predetermined standard value, it can be determined that the joining terminal 41A and the joining terminal 61A are properly joined together and that a joining terminal 41C and the joining terminal 61C are properly joined together. When a resistance that exceeds the predetermined standard value has been measured as a result of the resistance measurement (5A-5C), measurement of the resistance between the terminals of the contact pads 5B and 5C is performed. When the resistance is equal to or lower than the predetermined standard value, it is understood that there is a problem in the join between the joining terminal 41A and the joining terminal 61A.

As described above, by performing the resistance measurements on all the combinations of two terminals among the terminals of the contact pads 5A to 5C, the joint states of joint portions 41A/61A, 41B/61B, and 41C/61C can be inspected. In the case where a joint failure occurs in more than one of the joint portions, since the resistance increases with the number of joint failures, it can be determined whether the joint state is acceptable by checking the resistance in each of the resistance measurements.

The terminals of the contact pads 5A to 5C are used as the inspection terminals when the liquid discharge head 1 is inspected. However, in practical use, these terminals are used as the ground terminals of the discharge elements in a state where the terminals are mounted on a product.

In the present embodiment, although a case has been described in which the resistance measurements are performed on the three terminals located at the two end portions and the center portion, the present invention is not limited to such a case, and in the case where the width of the joining region is larger, the number of terminals to be measured may be increased in accordance with the width.

In addition, in the present embodiment, although a case has been described in which the resistance measurements are performed at the two end portions and at the center portion, the present invention is not limited to such a case, and if a position where a joint failure will possibly occur is known beforehand, the resistance measurement may be performed by disposing an inspection terminal at the position.

Furthermore, the liquid discharge head 1 that has been described above may be used as a liquid discharge apparatus that is configured to be capable of being equipped with the liquid discharge head 1.

As described above, at least three terminals among the joining terminals 61 are short-circuited, and the joining terminals 41 of the contact substrate 4 are connected to the corresponding contact pads 5, to each of which an external signal can be input. As a result, the liquid discharge head 1 in which inspection of the joint portions can be performed with high accuracy, a liquid discharge apparatus, and a method of inspecting the liquid discharge head 1 and the liquid discharge apparatus can be realized.

According to the present invention, a liquid discharge head in which inspection of a joint portion can be performed with high accuracy, a liquid discharge apparatus, and a method of inspecting the liquid discharge head and the liquid discharge apparatus can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-221840, filed Nov. 12, 2015, which is hereby incorporated by reference herein in its entirety.

What is claimed is:

1. A liquid discharge head comprising:

a discharge unit that discharges a liquid as a result of electric energy being supplied to the discharge unit;

a first wiring member that is joined to the discharge unit and that includes a plurality of first joining terminals each capable of transmitting the electric energy to the discharge unit; and a second wiring member that is electrically joined to the first wiring member and that includes a plurality of second joining terminals; and wherein at least three of the plurality of first joining terminals are inspection terminals that are short-circuited, and the second joining terminals are connected to contact terminals to each of which an external signal can be input, wherein a joint state of the first joining terminals and the second joining terminals is inspected by measuring a resistance between each two terminals among the at least three inspection terminals and comparing the resistance each with a predetermined value.

2. The liquid discharge head according to claim 1, wherein the first joining terminals are arranged side by side at an end of the first wiring member, and the inspection terminals among the first joining terminals, which are arranged side by side, are located at two ends and at the center of the first joining terminals.

3. The liquid discharge head according to claim 1, wherein the first wiring member and the second wiring member are joined together by thermocompression bonding that uses an anisotropic electroconductive tape.

4. The liquid discharge head according to claim 1, wherein the inspection terminals of the first wiring member are ground terminals of the discharge unit.

5. The liquid discharge head according to claim 1, wherein the first wiring member is a flexible cable that is capable of being significantly deformed.

6. The liquid discharge head according to claim 1, wherein the at least three inspection terminals include a first inspection terminal, a second inspection terminal, and a third inspection terminal, and the joint state is inspected by measuring a resistance between the first inspection terminal and the second inspection terminal, measuring a resistance between the second inspection terminal and the third inspection terminal, and measuring a resistance between the first inspection terminal and the third inspection terminal.

* * * * *